United States Patent [19]

Norton et al.

[11] Patent Number: 4,723,907

[45] Date of Patent: Feb. 9, 1988

[54] ATMOSPHERIC GAS BURNER

[75] Inventors: Colin W. Norton; James E. Addison, both of Rugby, England

[73] Assignee: Furigas (UK) Limited, Warwickshire, England

[21] Appl. No.: 819,984

[22] Filed: Jan. 15, 1986

Related U.S. Application Data

[63] Continuation of Ser. No. 576,409, Feb. 2, 1984, abandoned.

[30] Foreign Application Priority Data

Feb. 3, 1983 [GB] United Kingdom ..... 8302977

[51] Int. Cl.[4] ..... F23D 21/00

[52] U.S. Cl. ..... 431/354; 29/509; 29/157 R

[58] Field of Search ..... 431/354, 355, 286; 29/509, 157 R; 239/568, 566, 557, 556

[56] References Cited

U.S. PATENT DOCUMENTS

| | | | |
|---|---|---|---|
| 2,026,027 | 12/1935 | Evans | 431/355 |
| 2,852,070 | 9/1958 | Lognion et al. | 431/354 |
| 2,875,820 | 3/1959 | Nesbitt | 431/286 |
| 3,615,249 | 10/1971 | Martois | 431/354 |
| 3,656,879 | 4/1972 | De Vries, Jr. | 29/157 R |
| 3,694,133 | 9/1972 | Wilkerson | 431/286 |
| 3,991,941 | 11/1976 | Dornbach | 431/354 |
| 4,179,261 | 2/1979 | Riehl | 431/286 |
| 4,179,262 | 12/1979 | Wardt et al. | 431/354 |
| 4,195,785 | 4/1980 | Blanzy | 239/568 |
| 4,418,456 | 12/1983 | Riehl | 239/566 |

FOREIGN PATENT DOCUMENTS

| | | | |
|---|---|---|---|
| 0052191 | 7/1984 | European Pat. Off. | 431/354 |
| 1529217 | 12/1969 | Fed. Rep. of Germany | 431/354 |
| 2104691 | 5/1970 | Fed. Rep. of Germany | 239/556 |
| 1945073 | 3/1971 | Fed. Rep. of Germany | 431/354 |
| 2107997 | 9/1971 | Fed. Rep. of Germany | 431/354 |
| 2262524 | 7/1973 | Fed. Rep. of Germany | 431/354 |
| 2210174 | 9/1973 | Fed. Rep. of Germany | 431/354 |
| 2310968 | 9/1974 | Fed. Rep. of Germany | 431/354 |
| 519489 | 9/1916 | France | 431/328 |
| 1395430 | 3/1965 | France | 431/286 |
| 0138913 | 8/1983 | Japan | 431/354 |
| 301699 | 12/1963 | Netherlands | 431/286 |
| 7309791 | 7/1973 | Netherlands | 431/354 |
| 0166777 | 4/1981 | Netherlands | 431/341 |
| 1123648 | 8/1968 | United Kingdom | 431/354 |
| 1148943 | 4/1969 | United Kingdom | 431/354 |
| 1191993 | 5/1970 | United Kingdom | 431/354 |
| 1209023 | 10/1970 | United Kingdom | 431/354 |
| 1224443 | 3/1971 | United Kingdom | 431/354 |
| 1261797 | 1/1972 | United Kingdom | 431/354 |
| 1297005 | 11/1972 | United Kingdom | 431/354 |
| 1313721 | 4/1973 | United Kingdom | 431/328 |
| 1318306 | 5/1973 | United Kingdom | 431/354 |
| 1324775 | 7/1973 | United Kingdom | 431/354 |
| 1397536 | 6/1975 | United Kingdom | 431/354 |
| 2112674 | 6/1983 | United Kingdom | 431/354 |

*Primary Examiner*—Samuel Scott
*Assistant Examiner*—H. A. Odar

[57] ABSTRACT

The burner comprises a body for receiving gas and a plurality of spaced apart burner elements fixed to the body in a substantially gas tight manner. The elements locate in slots in the body with a slotted intermediate member arranged between the body and the element. Each of the elements has marginal portions which project through associated slots in the body and intermediate member. The portions are deformed so as to interconnect the body and the burner.

17 Claims, 7 Drawing Figures

ATMOSPHERIC GAS BURNER

Figure 1:
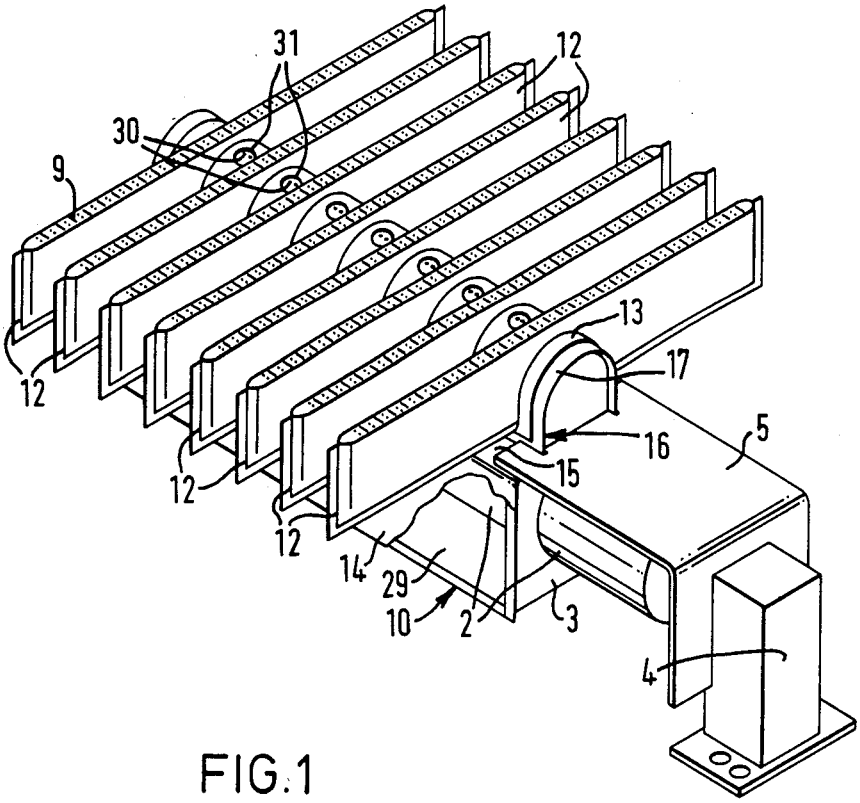

This application is a continuation of application Ser. No. 576,409, filed Feb. 2, 1984, now abandoned.

The invention relates to an atmospheric gas burner.

Hitherto it has been known to construct an atmospheric gas burner by welding e.g. spot welding, brazing or soldering burner elements to a gas receiver. Whilst such a manner of interconnecting the elements and receiver produces strong joints, it is generally labour intensive and therefore relatively costly. Also spot welding is particularly tedious and results in a burner which is unattractive from a sales aspect. An object of the present invention is to provide a gas burner which dispenses with the need to weld, braze or solder a burner element to a body.

According to the invention there is provided an atmospheric burner comprising a body for receiving gas and a burner element fixed to the body in a substantially gas-tight manner characterised in that the element is fixed to the body by deforming a portion of the element and/or the body.

Such an arrangement provides a simple mechanical interconnection between the body and the element which does not involve welding, brazing or soldering as required hitherto to provide a substantially gas-tight fixing.

Preferably an intermediate member engages parts of the body and the element in a substantially gas-tight manner. In such a case the intermediate member may be formed with a slot having ends which engage the element in a substantially gas-tight manner. Preferably the substantially gas-tight engagement of the ends of the slot and the element is effected by cold flow of the material of the element and/or the intermediate member during assembly of the burner. The use of the intermediate member greatly enhances sealing between the body and the element in a particularly simple manner.

The element may locate in a slot in the body and portions of the element may be deformed so as to overlie portions of the body adjacent the slot to fix the element to the body. In such a case the body may be formed with a part cylindrical surface formed with said slot and the element may define marginal sections which are deformed by bending so as to engage in a substantially gas-tight manner portions of the body adjacent the slot. The use of such marginal portions on the element provides a low cost and simple way of interconnecting the burner and body without the need for welding etc.

The intermediate member may simply comprise a part cylindrical plate or sheet formed by bending thin metal. Preferably the intermediate member and the part cylindrical portion of the body are of complementary shape.

Preferably the slot in the body terminates at ends short of the ends of the slot in the intermediate member so that the slot in the intermediate member extends alongside an unslotted portion of the body. The element may be formed with shoulders which engage the ends of the slot in the body in a substantially gas tight manner. The element may also be formed with edges which engage said unslotted portion of the body in a substantially gas-tight manner.

Figures 2, 2A:
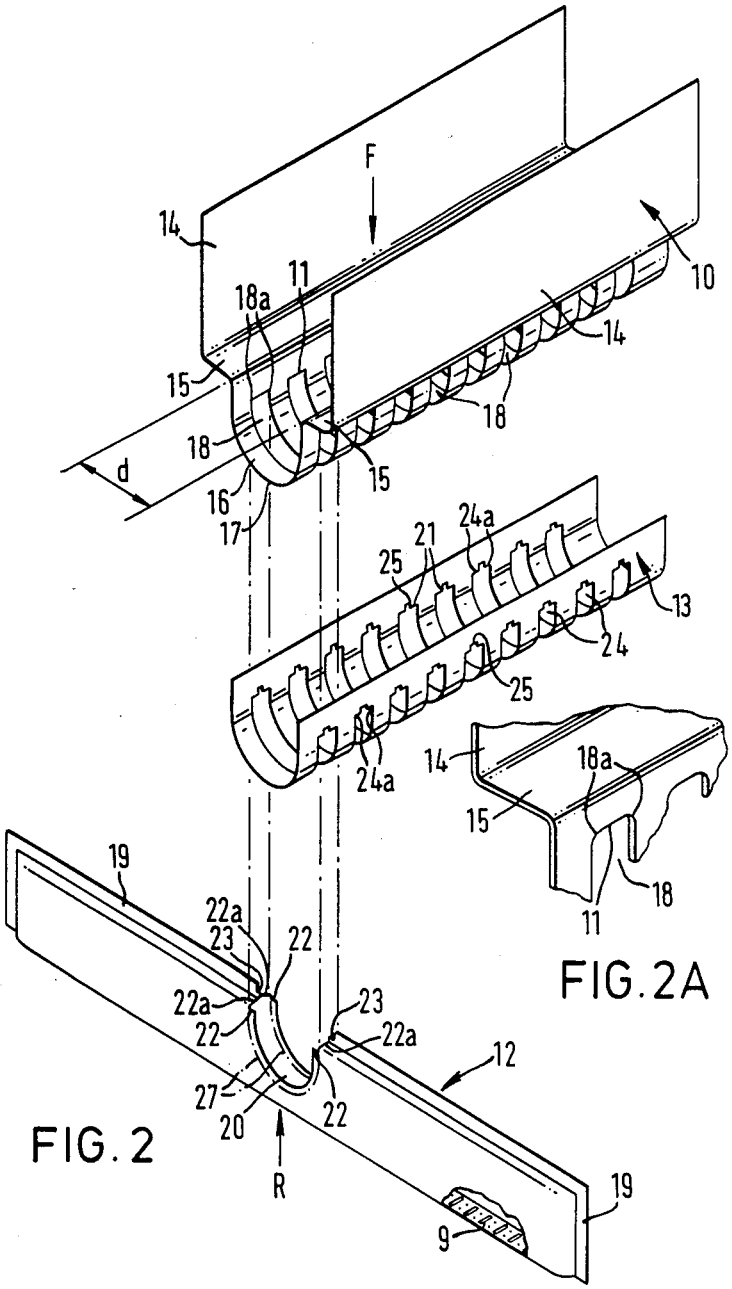
Figure 3:
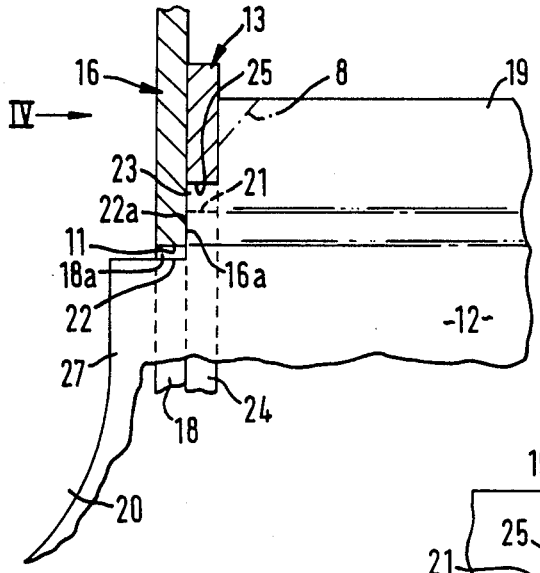
Figure 4:
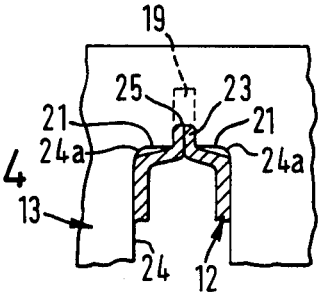
Figure 6:
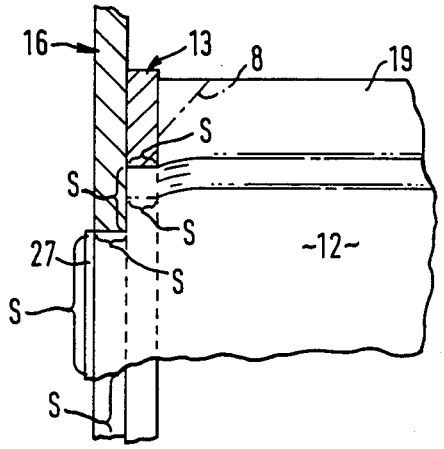
Figure 5:
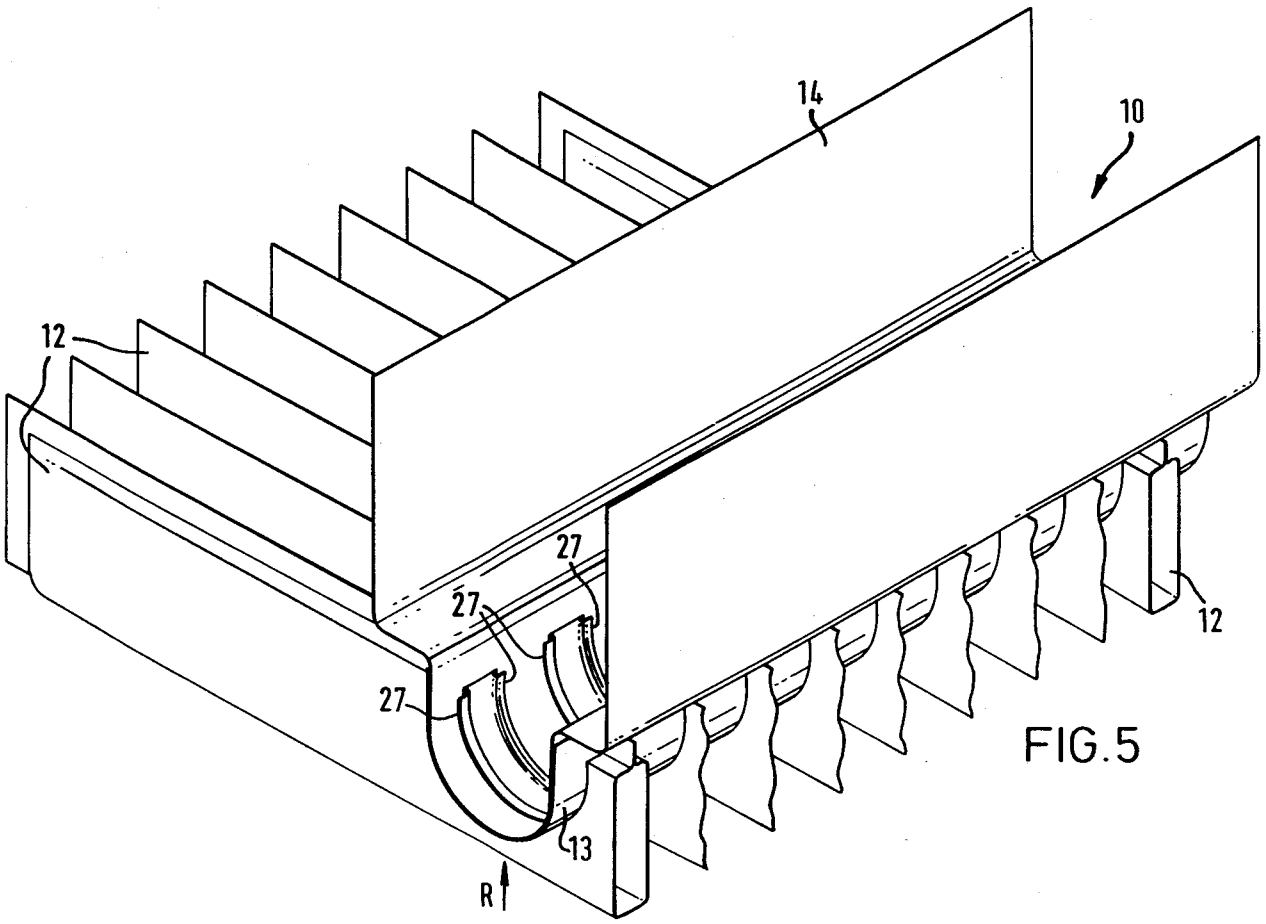

An atmospheric gas burner in accordance with the invention will now be described by way of example with reference to hte accompanying drawings in which:

FIG. 1 is a perspective view of a burner in accordance with the invention,

FIG. 2 is an inverted exploded view of part of the burner of FIG. 1 showing one burner element only, FIG. 2A is an enlarged view of part of the body of the burner in FIG. 2, FIG. 3 is a transverse cross section through part of the inverted burner shown partially assembled, FIG. 4 is a view in the direction of arrow IV in FIG. 3 with the body removed, FIG. 5 is a view of part of the burner of FIG. 1 in an assembled condition, and FIG. 6 is a view similar to FIG. 3 illustrating part of the fully assembled burner and indicating areas providing a substantially gas-tight seal.

In FIG. 1 a burner comprises a gas receiving body 10 (hereinafter called "a receiver") which carries a plurality of burner elements 12 and an intermediate member 13. The usual gas feed venturi or mixing tube 2 extends into the body from an end wall 3 and is supplied with gas from a gas feed unit 4. The unit is carried by a bracket 5 on the receiver 10. The receiver has side walls 14, inturned flanges 15 and an inverted U-shaped cross-section portion 16 having a cylindrical surface 17. As shown clearly in FIG. 2, the portion 16 is formed with a plurality of circumferential slots 18 having ends 11 and radiussed corners 18a (see FIG. 2A).

As shown in FIG. 2 each burner element 12 comprises a generally rectangular cross section tube having welded edge seams 19 and a generally U-shaped recess 20. The ends of the recess terminate at four shoulders 22, (three of which are shown in FIG. 2) which lie adjacent inner edges **22*a* of the element. The seams 19 are stepped at 23. The burner element is formed with gas outlets 9** in known manner.

The intermediate member 13 comprises a sheet of metal formed so that its internal surface is substantially of complementary shape to the external surface of the portion 16 of the receiver 10. The intermediate member is formed with slots 24 equal in number and spacing to the slots 18 in the receiver. The ends 21 of each slot 24 are formed with shallow recesses 25 and are radiussed at **24*a* in a manner similar to slots 18**.

To assemble the burner, the elements 12 are placed side by side in a carrier (not shown) with the recesses 20 facing upwardly as in FIG. 2 so as to align with the slots 24 in the intermediate member 13. The intermediate member 13 arranged as shown in FIG. 2 is then placed on the elements 12 so that marginal portions 27 of the elements project through the slots 24. The width of each slot 24 is such that the edges of the slots grip the sides of the burner elements. The receiver 10 is then placed in the intermediate member so that the marginal portions 27 of the elements project through the slots 18. The distance d between opposite inner surfaces of portion 16 is such that those surfaces grip the adjacent outer surfaces of the intermediate member 13. The complete assembly of the body 10, burners 12 and intermediate member 13 thus holds together frictionally. The arrangement of the assembled elements, receiver and intermediate member is shown in FIG. 3, the stepped portions 23 of each burner element 12 locating in the recesses 25 (see FIG. 4) with the shoulders 22 spaced from the ends 11 of the slot 18. A tool (not shown) is then applied to the receiver and a force F (FIG. 2) is applied to the tool with the burner elements 12 supported by a reaction member to provide a reaction R so that the portion 16 is urged firmly against the intermediate member and the ends 21 of the slots 24 are urged against the elements 12. The force F causes the material of each element 12 and/or the intermediate member 13 to "cold flow" in the area adjacent the ends 21 of each slot so that a substantially gas tight seal is achieved both between the stepped portions 23 and the recesses 25, and between the adjacent surfaces of the element 12 and the ends 21 and radiussed corners 24*a* of the slot 24. The application of force F also urges the shoulders 22 firmly against the radiussed section 18*a* of slots 18. The loading of the elements normally causes a small amount of distortion of the elements in the vicinity of the ends 21 of the slots 24 to effect the cold flow of material. The tool also deforms the marginal portion 27 of each element by urging them slightly outwardly over the interior surface of the portion 16 alongside the slots 18 to lock the assembled components together. The tool is then removed and a further tool is applied to urge the marginal portions 27 firmly against the interior surface of the portion 16 as shown clearly in FIGS. 5 and 6. Such a method of assembly effects a substantially gas tight seal between the portion 16 of the receiver 10 and the intermediate member 13, and between each element 12 and the portion 16 adjacent the associated slot 18. The method of assembly also causes the adjacent inner edges 22*a* of the element 12 and the unslotted adjacent outer surface of portion 16 to be urged into firm engagement with each other thereby forming a further substantially gas-tight seal. For that purpose the ends 21 of the slots 24 lie closer to the flanges 15 than the ends 11 of slots 18. A substantially gas-tight fit is also achieved between the shoulders 22 and the radiussed sections 18*a* of slots 18.

Substantially gas-tight sealing is therefore effected at the areas marked S in FIG. 6 by means of simple mechanical operations which are reliable, less costly and less labour intensive than fixing the elements by welding, soldering or brazing.

The burner is completed by adding a base 29 (FIG. 1) and end walls 3 (one only of which is shown in FIG. 1).

The receiver 10 may be made from stainless steel and the intermediate member 13 may be made from a similar material or an alternative material such as aluminium. The elements 12 will normally be made from stainless steel.

It is envisaged that the portion 16 of the receiver may be formed to provide sections which can be bent to secure the burner elements on to the receiver instead of or in addition to bending a portion of the burner elements.

In order to provide a lead-in for each burner element 12 during assembly, the seams 19 may be cut away as indicated by broken lines 8 in FIGS. 3 & 6 adjacent the steps 23.

As shown in FIG. 1, cross lighting holes 30 may be provided in the body portion 16 between the slots 18. In such a case the intermediate member 13 is formed with clearance apertures 31 which reveal the cross lighting holes.

What we claim as our invention and desire to secure by Letters Patent in the United States is:

1. An atmospheric gas burner comprising:

a body for receiving gas, a burner element having side walls, and an intermediate member between said body and said burner element said body having an elongate form and defining a first surface, said surface having a first transverse slot defined by a pair of side edges and a pair of end edges, said intermediate member defining a second surface of complementary shape to and engaging said first surface on said body, said second surface having a second transverse slot shaped and sized to register with said first transverse slot, said second transverse slot having recesses extending beyond the end edges of said first transverse slot;

said burner element having a hollow interior and a peripheral seam with a gas outlet opening on one edge and a gas inlet opening on an opposed edge, the burner element being located in said first and second transverse slots and the side walls of said burner element being of a spacing and thickness to engage the side edges of said first and second transverse slots;

said gas inlet opening being bounded by first and second shoulders, said first shoulders being in said side walls of said burner element and said second shoulders being in the peripheral seam of said burner element, said first shoulder engaging the end edges of said first transverse slot and said second shoulders engaging said recesses whereby a gas tight assembly is obtained between said body, said intermediate member and said gas inlet opening of said burner element.

2. An atmospheric gas burner according to claim 1 in which the body is of elongate form and has a plurality of transverse slots in said non-planar section, a plurality of said burner elements being located in the respective slots.

3. An atmospheric gas burner as claimed in claim 2 in which said body and said intermediate member have an equal number of said first and second spaced transverse slots respectively, each of said first and second transverse slots being spaced from a slot immediately adjacent thereto by an equal distance.

4. An atmospheric gas burner including:

a body for receiving gas, a plurality of burner elements, an intermediate member between the body and said burner elements, said body being of elongate form and having a plurality of first transverse slots in a non-planar surface thereof, said intermediate member having a non-planar surface of complementary shape to the non-planar surface of said body and which engages said non-planar surface on said body, said intermediate member having a plurality of second transverse slots in register with said first transverse slots, each said burner element having side wall portions which are disposed in a pair of registered said first and second slots and portions which engage end sections of such slots, said side wall portions defining margin portions adjacent the registered first and second slots which are bent so as to sealingly engage the inner surface of said body to hold each burner element in substantially gas tight engagement with the body.

5. An atmospheric gas burner as claimed in claim 4 in which the non-planar surface of the body engaged by said non-planar surface of the intermediate member includes a part-cylindrical section.

6. An atmospheric gas burner according to claim 4 in which the slots in the intermediate member have recesses in the end sections thereof, each of which recesses receives a portion of the burner element positioned in that slot.

7. An atmospheric gas burner according to claim 4 in which each said burner element has a hollow interior and a peripheral seam with a gas outlet opening on one edge and a gas inlet opening on an opposed edge, the gas inlet opening being defined by said side wall portions.

8. An atmospheric gas burner according to claim 7 in which said margin portions are margins of the side wall portions adjacent the inlet opening.

9. An atmospheric gas burner according to claim 7 in which said gas inlet opening of each burner element has first and second shoulders, said first shoulders being in said side wall portions and said second shoulders being in said peripheral seam.

10. An atmospheric gas burner according to claim 9 in which said first shoulders of each burner element engage the end sections of one of the slots in said body in a gas-tight manner and said second shoulders locate in recesses in the end sections of one of the registered slots in the intermediate member in a gas-tight manner.

11. An atmospheric gas burner according to claim 10 in which each burner element engages in a gas-tight manner portions of said surface of the body between the end sections of the associated slot in the body and the adjacent end sections of the registered slot in the intermediate member.

12. An atmospheric gas burner including:

a body for receiving gas and having a non-planar surface section forming part of the body, a burner element, said body having a slot in said non-planar section, said burner element having side wall portions located in said slot and including bent margin portions which sealingly engage inner surface portions of said non-planar section adjacent the slot whereby the burner element is held in substantially gas-tight engagement with the body, said burner element having a hollow interior with a gas outlet opening on one edge and a gas inlet opening on an opposite edge, the gas inlet opening being defined by said side wall portions, said bent margins comprising margins of said side wall portions adjacent the inlet opening.

13. An atmospheric gas burner according to claim 12 in which said bent margin portions are of arcuate shape.

14. An atmospheric gas burner according to claim 13 in which the bent margin portions are of complementary shape to the inner surface portions of said non-planar section of the body.

15. An atmospheric gas burner according to claim 12 in which said gas inlet opening of each burner has shoulders which engage said end sections of the associated slot in the body in a gas-tight manner.

16. An atmospheric gas burner according to claim 15 in which said non-planar section is part-cylindrical.

17. An atmospheric gas burner according to claim 12 in which the body is of elongate form and has a plurality of transverse slots in said non-planar section, a plurality of said burner elements being located in the respective slots.

* * * * *